United States Patent [19]

Shannon

[11] Patent Number: 5,065,942

[45] Date of Patent: Nov. 19, 1991

[54] SHOWER SPRAY SYSTEM

[76] Inventor: Timothy L. Shannon, 1901 Sackett Ave., Cuyahoga Falls, Ohio 44223

[21] Appl. No.: 487,927

[22] Filed: Mar. 5, 1990

[51] Int. Cl.[5] ..... B05B 7/08; B05B 15/08

[52] U.S. Cl. ..... 239/282; 239/418; 239/423; 239/549

[58] Field of Search ..... 4/515-518, 4/567-570, 597, 605, 615; 239/280, 282, 283, 413, 418, 423, 549, 280.5

[56] References Cited

U.S. PATENT DOCUMENTS

| | | | |
|---|---|---|---|
| 405,528 | 6/1889 | Brown | 239/549 |
| 1,959,886 | 5/1934 | Wadsworth | 239/280.5 |
| 2,884,205 | 4/1959 | Van Buren | 239/549 X |
| 2,949,109 | 8/1960 | Koonis | 239/549 X |
| 2,949,240 | 8/1960 | Koolnis | 239/549 X |
| 3,199,789 | 8/1965 | James | 239/423 |
| 3,208,145 | 9/1965 | Turner | 239/549 X |
| 3,822,825 | 7/1974 | Duppe | 239/423 X |

FOREIGN PATENT DOCUMENTS

| | | | |
|---|---|---|---|
| 1401437 | 7/1975 | United Kingdom | 239/280.5 |

*Primary Examiner*—Andres Kashnikow
*Assistant Examiner*—William Grant
*Attorney, Agent, or Firm*—Renner, Kenner, Greive, Bobak, Taylor & Weber

[57] ABSTRACT

A shower spray system includes a shower head which is positionally adjustable on a vertical rod. The shower head interconnects with a source of water under pressure and a source of air under pressure. The shower head includes a plurality of nozzles, certain of which communicate with the water source to emit water, and others of which communicate with the air source to emit air. In operation, the shower head emits a mist of water from the water nozzles, and a plurality of air streams from the air nozzles. The result is the sensation of greater water flow than actually achieved by the shower head and increased rinsing of the body with decreased water flow.

12 Claims, 1 Drawing Sheet

SHOWER SPRAY SYSTEM

TECHNICAL FIELD

The invention herein resides in the art of water shower systems as employed for personal hygiene. More particularly, the invention relates to a water shower system adapted to minimize water usage while providing thorough and complete shower activity.

BACKGROUND ART

Showering is a well known technique for cleaning the body. It provides for a constant flow of clear water over the body, allowing soap, suds, and body soil to be continually removed during the showering operation. The constant flow of water incident to showering activities gives rise to undersirably high levels of water usage. In an age of conservation, excessive use of water is most undesirable. Further, in many municipalities the cost of water is extremely high, making it most desirable to limit water usage to the greatest extent possible.

It has previously been thought that the efficiency by which dirt, soap, or suds may be removed from one's body in a shower is a function of the volume of water caused to flow from the shower head and onto the user's body. Accordingly, large volumes of water were believed necessary to properly clean the body and to rinse from it all soap and dirt residue. Applicant has, however, found that air flow can be used to supplement water flow from a shower head, allowing the water flow rate to be reduced while still effecting the same cleansing operation. The air flow can blow the residue and soap from the body, while the water continues to perform its rinsing function.

Previously, it has not been known to combine both air and water flow from a shower head. It has been previously known to meter soap or bath oil into the water stream of a shower head, as taught by U.S. Pat. Nos. 4,623,095 and 3,446,438. It has further been known that separate nozzles may be provided in a shower head for emitting hot and cold water, such that the mixing of hot and cold water occurs on the user's body. Such structure has been taught in U.S. Pat. Nos. 1,733,054 and 2,949,240. However, it has not been known to provide a shower head having certain nozzles emitting water and certain other nozzles for emitting air under pressure.

DISCLOSURE OF INVENTION

In light of the foregoing, it is a first aspect of the invention to provide a shower system which reduces water flow.

Another aspect of the invention is to provide a shower system in which the shower head emits both air and water.

Still a further aspect of the invention is the provision of a shower system in which the shower head emits air at a velocity sufficient to cleanse suds and soap from the user's body.

Another aspect of the invention is the provision of a shower system in which the shower head is vertically adjustable to accommodate users of various heights.

Yet an additional aspect of the invention is the provision of a shower system which is reliable and durable in operation, and simple to construct with state of the art components.

The foregoing and other aspects of the invention which will become apparent as the detailed description proceeds are achieved by a shower spray system, comprising: a source of air under pressure; a source of water under pressure; and a shower head interconnecting said sources of air and water for emitting air and water therefrom.

Other aspects of the invention which will become apparent herein are attained by a shower system, comprising: a source of air under pressure; a source of water under pressure; a rod; and a shower head slidingly received upon said rod.

BRIEF DESCRIPTION OF DRAWING

For a complete understanding of the objects, techniques, and structure of the invention reference should be made to the following detailed description and accompanying drawing wherein.

BEST MODE FOR CARRYING OUT THE INVENTION

Figure 1:
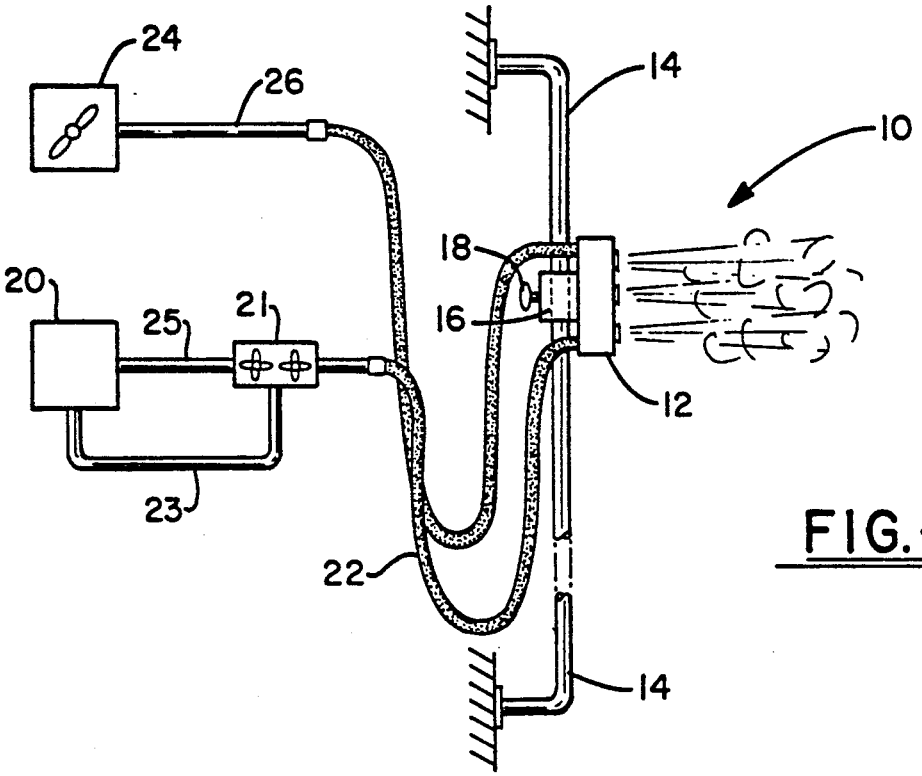
FIG. 1 is a side illustrative view of the shower spray system of the invention.

Referring now to the drawing and more particularly FIG. 1, it can be seen that a shower spray system according to the invention is designated generally by the numeral 10. A shower head 12 is received upon a rod 14 which is appropriately affixed to the wall of a shower or other suitable structure. In a preferred embodiment of the invention, the rod 14 is vertical, allowing for height adjustments of the positioning of the shower head 12.

A sleeve 16 connects to the shower head 12 and is slidingly received upon the rod 14. A locking screw 18 is threadedly received in a bore within the sleeve 16 and is adapted for making locking contacting engagement with the rod 14. In operation, the locking screw 18 is loosened, the head 12 is vertically positioned by sliding the sleeve 16 upon the rod 14, and the locking screw 18 is subsequently tightened against the rod 14 to hold the head 12 in fixed position. It is also contemplated as part of the invention that the sleeve 16 may frictionally receive the rod 14 such that the head 12 will maintain a set position upon the rod 14, changes in position requiring only the application of manual force to slide the sleeve 16 upon the rod 14. It will be readily appreciated that the desirability of such a vertical adjustment of the shower head 12 is to accommodate individuals of various heights and/or to direct the shower spray upon various selected portions of the user's body.

As shown in FIG. 1, the shower spray system 10 includes a source of water pressure 20, which could comprise any suitable source such as a municipal water supply, pressurized reservoir tank for well water systems, or the like. Typically, the source 20 includes a hot water source as well as a cold water one. A mixer valve 21 receives cold water under pressure through the line 23, and hot water under pressure through the line 25. Water under pressure and of desired temperature is passed from the mixer valve 21 through the hose 22 to the shower head 12. The hose 22 is preferably a flexible hydraulic line to accommodate the movement of the shower head 12 upwardly and downwardly upon the rod 14. Such hoses, typically of rubber or synthetic material, are well known in the art. In a preferred embodiment, the mixer valve 21 is connected by a pipe to the shower "nipple," to which the hose 22 is attached.

As a portion of the invention, an air pressure source 24 is provided in communication with the shower head 12 through a flexible hose or the like 26. Again, the hose 26 is preferably flexible to accommodate vertical movement of the shower head 12 upon the rod 14. The air pressure source 24 may comprise an appropriate electrical blower motor or fan, but could also comprise a self contained pressurized source having a suitable control valve associated therewith to limit the pressure or force of air emitted therefrom.

Figure 2:
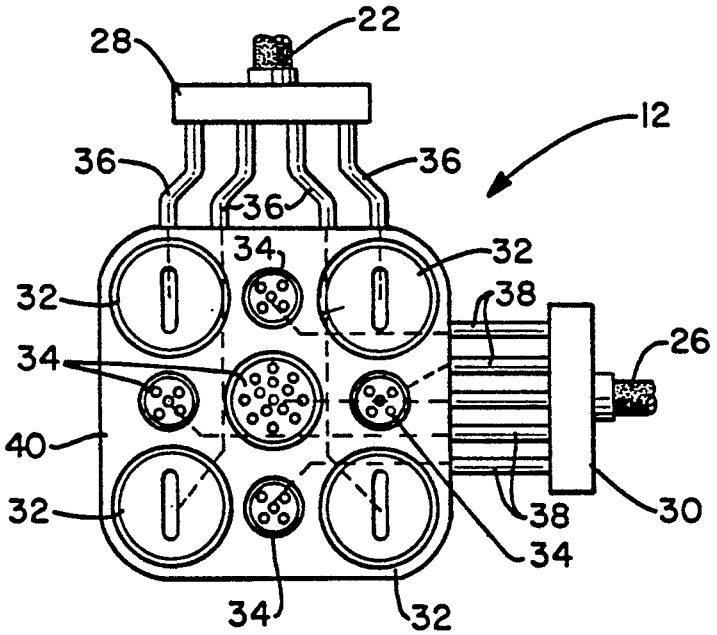
FIG. 2 is a front illustrative view of the shower head of the spray system of the invention.

As best shown in FIG. 2, a manifold or splitter 28 is interconnected with the water line 22 and a similar manifold or splitter 30 is interconnected with the air line 26. The manifold 28 receives the single input from the flexible water line 22 and directs it through a plurality of output water lines 36 to an equal plurality of water spray nozzles 32. In similar fashion, the manifold 30 receives the air input supply line 26 and through a plurality of output lines 38, directs the air to air spraying nozzles 34. The spray nozzles 32, 34 are maintained within the shower head housing 40 and, in the preferred embodiment, are uniformly and symmetrically interspersed with each other. As shown in the embodiment of FIG. 2, water spray nozzles 32 are provided in 90° separation at the corners of the housing 40, with the small air nozzles 34 positioned in 90° separation therebetween. A larger air nozzle 34 is positioned at the center of the housing 40.

In a preferred embodiment of the invention, the water spray nozzles 32 comprise fan spray heads having a characteristic spray angle of 15°-75°. The water spray nozzles preferably are pivotable about a point to adjust spray direction. Typically, the nozzles 32 will angle inwardly toward each other.

In the preferred embodiment of the invention, the water nozzles 32 emit water in a heavy mist, not a strong stream. The air spray nozzles 34 are configured to emit a high volume of air at a speed sufficient to excite the skin of the user, without causing discomfort. Accordingly, the shower head 12 presents a mist of water at low volume, conserving water consumption, while the air forced upon the user's body through the nozzles 34 generates the sensation of a greater flow volume of water, assists in cleansing residue and/or suds from the user's body, and gives the sensation of a high volume of water flow.

In a preferred system, the water spray nozzles are configured to operate at household water pressure on the order of 50 psi, emitting a spray mist of water at the rate of ½-1 gallons per minute. The air nozzles 34 are selected to move up to 100 cfm at 52 inch static pressure, being insufficient to harm the flesh of the user.

It has been found that using a shower spray system such as that presented herein, water consumption can be cut in half while achieving the same cleansing result and physical sensations.

Thus it can be seen that the objects of the invention have been satisfied by the structure presented above. While in accordance with the patent statues only the best mode and preferred embodiment of the invention has been presented and described in detail, it is to be understood that the invention is not limited thereto or thereby. Accordingly, for an appreciation of the true scope and breath of the invention reference should be made to the following claims.

What is claimed is:

1. A shower spray system, comprising:

a source of air under pressure;

a source of water under pressure, said source comprising sources of hot and cold water;

a mixer valve interconnected with said sources of hot and cold water, mixing water therefrom to a desired temperature; and a shower head interconnecting said source of air and said mixer valve for emitting air and water therefrom, said shower head comprising a plurality of first and second nozzles, said first nozzles being interconnected with said source of air, and said second nozzles being interconnected with said source of water, said second nozzles comprising fan spray heads.

2. The shower spray system according to claim 1, wherein said first nozzles are uniformly interspersed with said second nozzles.

3. The shower spray system according to claim 1, further comprising a first manifold interposed between said source of air and said first nozzles, and a second manifold interposed between said mixer valve and said second nozzles.

4. The shower spray system according to claim 1, further comprising a rod slidingly receiving said shower head.

5. The shower spray system according to claim 4, wherein said shower head is frictionally retained on said rod at selected positions therealong.

6. The shower spray system according to claim 4, further comprising releasable locking means for selectively positionally securing said shower head on said rod.

7. The shower spray system according to claim 4, further comprising a pair of extendable and flexible hoses interconnected with said air and water sources, said hoses accommodating movement of said shower head upon said rod.

8. A shower spray system, comprising:

a source of air under pressure;

a source of water under pressure, said source of water comprising sources of hot and cold water;

a mixer valve interconnected with said sources of hot and cold water, mixing water therefrom to a desired temperature;

a rod; and a shower head slidingly received upon said rod and connected to said source of air and said mixer valve for emitting air and water therefrom, said shower head comprising a plurality of spray nozzles, a first set of said nozzles interconnecting with said air source and a second set of said nozzles interconnecting with said source of water through said mixer valve, said second set of nozzles comprising fan spray heads emitting a mist of water.

9. The shower spray system as recited in claim 8, wherein flexible hoses interconnect said air and water sources with said shower head.

10. The shower spray system as recited in claim 9, wherein said first and second sets of nozzles are uniformly interposed between each other.

11. The shower spray system as recited in claim 9, wherein said source of air under pressure comprises a blower.

12. The shower spray system as recited in claim 9, wherein said shower head comprises a sleeve received upon said rod, said sleeve having locking means for selectively securedly engaging said rod and preventing movement of said sleeve upon said rod.

* * * * *